US007539453B2

(12) United States Patent
Otome et al.

(10) Patent No.: US 7,539,453 B2
(45) Date of Patent: May 26, 2009

(54) PRINTER CAPABLE OF RESERVING SHEET WRAPPING WIDTH

(75) Inventors: Yukio Otome, Hitachinaka (JP); Isao Nakajima, Hitachinaka (JP); Sho Sawahata, Hitachinaka (JP); Akihiko Yamazaki, Hitachinaka (JP); Yukinori Sakuma, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 231 days.

(21) Appl. No.: 11/107,820

(22) Filed: Apr. 18, 2005

(65) Prior Publication Data

US 2005/0232670 A1 Oct. 20, 2005

(30) Foreign Application Priority Data

Apr. 16, 2004 (JP) ..... 2004-121266

(51) Int. Cl.
*G03G 15/00* (2006.01)
*G03G 15/01* (2006.01)

(52) U.S. Cl. ..... 399/384; 399/361; 399/130; 399/299

(58) Field of Classification Search ..... None
See application file for complete search history.

(56) References Cited

U.S. PATENT DOCUMENTS 5,274,428 A * 12/1993 Wong et al. ..... 399/300
5,298,960 A * 3/1994 Fukuchi et al. ..... 399/29
5,455,668 A * 10/1995 De Bock et al. ..... 399/299
6,320,682 B1 * 11/2001 Azumai et al. ..... 358/509
6,360,073 B1 * 3/2002 Eelen ..... 399/327
6,567,621 B2 * 5/2003 Miyoshi et al. ..... 399/19
6,996,354 B2 * 2/2006 Kimura et al. ..... 399/121
7,218,883 B2 * 5/2007 Aruga et al. ..... 399/302

FOREIGN PATENT DOCUMENTS

JP 61019384 A * 1/1986
JP 07-072776 3/1995
JP 07-077851 3/1995

* cited by examiner

*Primary Examiner*—Jill E Culler
*Assistant Examiner*—'Wyn' Q Ha
(74) *Attorney, Agent, or Firm*—Antonelli, Terry, Stout & Kraus, LLP.

(57) ABSTRACT

To provide a printer capable of minimizing the effect of a wrapping member, which is used for wrapping a recording form around a photoconductor, on image quality and realizing high image quality printing, a conveying roller 6, wrapping roller 8, and transfer units 36*a* and 36*b* are arranged so that a line La connecting a center Ca of a roller 38*a* and a transfer point Ta and a line Lb connecting a center Cb of a roller 38*b* and a transfer point Tb are inclined to a central line A-A and are almost symmetric to the central line A-A. When the wrapping width W of the form around belt photoconductors 32*a* and 32*b* is specified to 5 mm≦W≦25 mm, even when a wrapping roller is not arranged between printing units 30*a* and 30*b*, a fixed wrapping width of the form S around the belt photoconductors 32*a* and 32*b* is reserved.

11 Claims, 9 Drawing Sheets

PRINTER CAPABLE OF RESERVING SHEET WRAPPING WIDTH

BACKGROUND OF THE INVENTION

The present invention relates in general to a printer; and, more particularly, the invention relates to a printer that is capable of reserving the sheet wrapping width onto photoconductors by use of very few wrapping members.

A printer for executing multi-color printing, while vertically conveying a form, such as a continuous web, has a constitution in which a plurality of drum photoconductors are arranged in a zigzag manner on both sides of the form, and toner images are alternately formed on the first side and second side of the form and then are fixed by a fixing unit, with the result that double-side multi-color printing is executed in one process. In this printer, the drum photoconductors are rotated by following the form, so that the form must be wrapped around the drum photoconductors with a fixed wrapping width, and a transfer section is installed in the neighborhood of the intersection point between a horizontal line passing through the center of the drum photoconductors and the form (for example, refer to Patent Document 1).

Further, the technique of reserving the fixed wrapping width of the form for the photoconductors, thereby increasing the transfer width and realizing a high image quality, is generally known.

On the other hand, for printing only on the first side of the form, as shown in FIG. 7, there is a known constitution in which, by use of a wrapping roller 108 installed on the second side of the form, a fixed wrapping width of the form for a drum photoconductor 101 is reserved. Even in such a constitution, a transfer unit 106 is installed in the neighborhood of the intersection point between a horizontal line LH passing through a center 101*c* of the drum photoconductor 101 and the form (for example, refer to Patent Document 2).

Further, there is a known constitution in which a first side printing section and a second side printing section are separately installed in one frame; and, after completion of printing on the first side, printing on the second side is executed. Namely, in this constitution, one-side printing is repeated at two steps in one frame, so that double-side printing is executed (for example, refer again to Patent Document 2).

Patent Document 1: Japanese Application Patent Laid-open Publication No. Hei 07-77851

Patent Document 2: Japanese Application Patent Laid-open Publication No. Hei 07-72776

SUMMARY OF THE INVENTION

However, in the aforementioned constitution in which a plurality of drum photoconductors are arranged on both sides of the form, between the drum photoconductors arranged in an up and down manner on the first side of the form, the drum photoconductor is always positioned on the second side of the form; and, for example, when the drum photoconductor on the second side is eccentric, the conveying speed of the form is varied, and a problem arises in that the image quality on the first side becomes deteriorated. Further, the conveying path of the form is formed by the drum photoconductors that are arranged on both sides of the form, so that, for example, even when printing only on the first side, mounting of drum photoconductors on the second side is essential, and problems of a short life span of parts due to contact wear between the drum photoconductors and the form and an increase in the cost of expendables arise.

On the other hand, even in the constitution for effecting one-side printing, as shown in FIG. 7, between the drum photoconductors 101 arranged in an up and down manner on the first side of the form, the wrapping roller 108 is always positioned on the second side of the form; so that, when the wrapping roller 108 is eccentric, the conveying speed of the form is varied, and a problem arises in that the image quality becomes deteriorated.

Furthermore, in the constitution in which one-side printing of the form is repeated in one frame at two steps, so that double printing is executed, after completion of the printing step on the first side, the form is conveyed in contact with the drum photoconductors and with many guide rollers in the second side printing section, so that problems of a short life span of parts due to contact wear between the drum photoconductors and the form and an increase in cost of expendables, as well as a problem of deterioration of print images on the first side, arise.

Therefore, it is an object of the present invention to provide a printer that is capable of minimizing the effect of the wrapping member on the image quality.

Further, it is an object of the present invention to provide a printer that is capable of preventing a short life span of parts, an increase in cost of expendables, and deterioration of the image quality by eliminating members not taking part in printing.

To accomplish the above-stated objects, the present invention provides a printer for forming a toner image on a recording medium, which comprises a first printing unit for forming a toner image on the first side of the recording medium to be conveyed and a second printing unit for forming a toner image on the first side of the recording medium, wherein the first printing unit has a first rotation member arranged on the first side of the recording medium and a first transfer unit arranged opposite to the first rotation member for transferring a toner image onto the first side of the recording medium at the first transfer position, and the second printing unit has a second rotation member arranged on the first side of the recording medium and a transfer unit arranged opposite to the second rotation member for transferring a toner image onto the first side of the recording medium at the second transfer position, whereby a first straight line connecting the central point of the first rotation member and the first transfer position is inclined relative to the perpendicular direction to a second straight line connecting the first transfer position and the second transfer position, and when the recording medium is conveyed between the first transfer position and the second transfer position along the second straight line, the recording medium is conveyed with a wrapping width W for each rotation member, and the wrapping width W is 5 mm$\leqq$W$\leqq$25 mm.

By use of such a constitution, on the first side of the recording medium, a toner image is formed by the first printing unit, and then a toner image in a different color is formed by the second printing unit, whereby a color toner image is formed. Further, between the first printing unit and the second printing unit, no wrapping member is installed, and, furthermore, in the first printing unit, a sufficient transfer width can be reserved, thus uneven print concentration due to a non-uniform transfer efficiency and image rubbing at the time of transfer due to a speed difference between the recording medium and the rotation members are reduced, so that the print quality can be improved.

Further, the invention is characterized in that, in the configuration described above, the first straight line and a third straight line connecting the central point of the second rotation member and the second transfer position are almost symmetric to a fourth straight line passing through the intermediate point between the first transfer position and the second transfer position and extending perpendicularly to the second straight line. By use of such a constitution, between the first printing unit and the second printing unit, no wrapping member is installed, and in the second printing unit, a sufficient transfer width can be reserved.

Further, the invention further comprises, in the configuration described above, a first side printing section having a first printing unit and a second printing unit, a second side printing section for forming a toner image on the second side opposite to the first side of the recording medium, and a fixing section for fixing a toner image that has been transferred to the recording medium, and the first side printing section, the second side printing section, and the fixing section are formed respectively in different frames, and the frames are removably fixed to each other.

Further, the invention is characterized in that the recording medium, in the first printing section and the second printing section, is conveyed vertically upward from below.

Further, the invention is characterized in that the second side printing section has at least one third printing unit for forming a toner image on the second side of the recording medium and the concerned third printing unit has the same constitution as that of the first printing unit or a mirror constitution thereof.

Further, the invention is characterized in that the first rotation member and the second rotation member are drum photoconductors.

Further, the invention is characterized in that the first printing unit further has an endless belt photoconductor wrapped around the first rotation member, and the second printing unit further has an endless belt photoconductor wrapped around the second rotation member.

According to the present invention, no wrapping member is installed between the first printing unit; and, the second printing unit and in the first printing unit, a sufficient transfer width can be reserved, so that the effect of the eccentricity of the wrapping member on the image quality can be minimized and images of high image quality can be obtained. Further, due to a reduction in the number of parts, the manufacturing cost of the whole printer can be decreased.

According to the invention, even in the second printing unit, a sufficient transfer width can be reserved and images of higher image quality can be obtained.

According to the invention, by mounting or demounting the second side printing section, the printer, when necessary, can be structured optionally as a one-side printer or a double-side printer. When the printer is structured as a one-side printer, the second side printing section, which does not take part in printing, is removed, so that the life span of the parts can be lengthened.

According to the invention, the recording medium conveying path from the first side printing section to the fixing section, when the printer is structured as a one-side printer, and the recording medium conveying path from the second side printing section to the fixing section, when the printer is structured as a double-side printer, are almost the same, and the second side printing section can be mounted and demounted easily.

According to the invention, a decrease in cost by sharing the parts can be realized, and the image qualities on the first and second sides can be made uniform.

According to the invention, a toner image formed on the drum photoconductor is transferred to the recording medium.

According to the invention, a belt photoconductor is used as a photoconductor, so that multi-color printing can be executed without increasing the volume of the whole printer.

According to the invention, when an interspaced transfer unit supported so as to be endlessly movable is used, a constant wrapping width on the photoconductor can be obtained.

DETAILED DESCRIPTION OF THE PREFERRED EMBODIMENT

Figure 1:
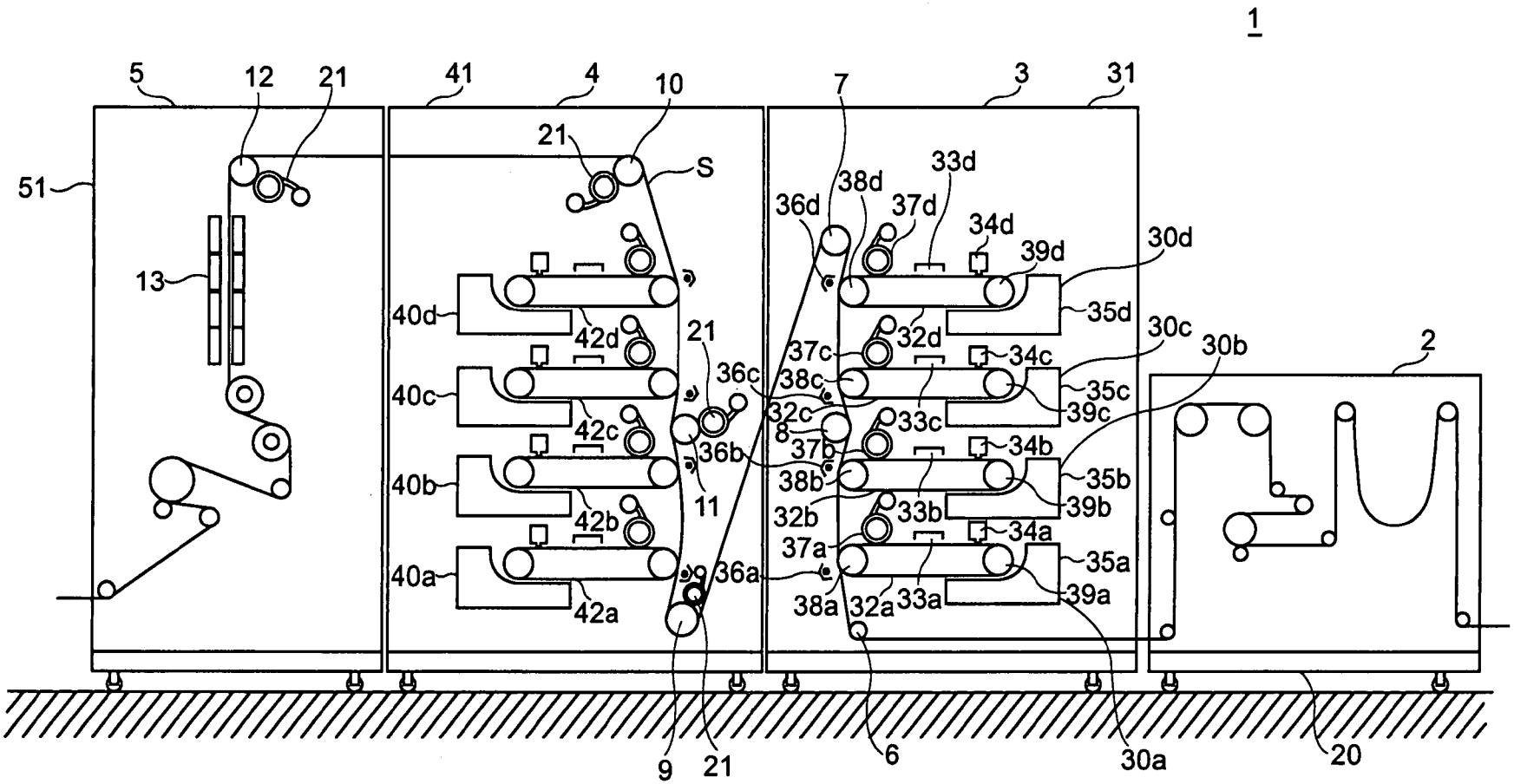
FIG. 1 is a diagram of a printer representing an embodiment of the present invention.

A printer 1 according to an embodiment of the present invention will be explained with reference to FIGS. 1 to 3. As shown in FIG. 1, the printer 1 of this embodiment includes a paper feed unit 2, a first side printing section 3, a second side printing section 4, and a fixing section 5. The paper feed unit 2 feeds a form S, such as a web, to the first side printing section 3. The first side printing section 3 forms a toner image on the first side of the form S, and the second side printing section 4 forms a toner image on the second side opposite to the first side of the form S. The fixing section 5 fixes a toner image on the form S and discharges the form S to the outside. The paper feed unit 2, the first side printing section 3, the second side printing section 4, and the fixing section 5 are respectively arranged in separate frames 20, 31, 41, and 51, and the frames 20, 31, 41, and 51 are removably fixed by connection members or joining members, such as screws, which are not illustrated.

The first side printing section 3 includes form conveying rollers 6 and 7, a wrapping roller 8, and printing units 30*a*, 30*b*, 30*c*, and 30*d*, which are sequentially arranged vertically upward from below. The printing units 30*a*, 30*b*, 30*c*, and 30*d* respectively form toner images of yellow, magenta, cyan, and black that are necessary for color printing on the form S. The printing units 30*a* to 30*d* have the same constitution, so that here, as an example, the printing unit 30*a* will be explained.

The printing unit 30*a* includes a pair of rollers 38*a* and 39*a*, a belt photoconductor 32*a* that wraps around the rollers 38*a* and 39*a*, a charger 33*a*, an exposure section 34*a*, a developing unit 35*a*, a transfer unit 36*a*, such as a colotron, and a cleaner 37*a*, which are arranged sequentially in the peripheral direction of the belt photoconductor 32*a*. When a printing operation start signal is outputted from a controller (not illustrated), the roller 38*a* and 39*a* start rotation at a speed corresponding to a predetermined printing speed. The belt photoconductor 32*a* is photo conductive and rotates around the rollers 38*a* and 39*a* in correspondence with the conveying of the form S. The charger 33*a* applies, for example, a negative high voltage to the belt photoconductor 32*a* to uniformly charge the surface of the belt photoconductor 32*a*. On the basis of character data and figure data sent from the controller, which data is converted to dot images, the exposure section 34*a* irradiates a laser beam onto the surface of the belt photoconductor 32*a* that is uniformly charged. By doing this, the charge an the surface of the belt photoconductor 32*a* irradiated by the laser beam is lost and an electrostatic latent image is formed. The developing unit 35*a* feeds toner which is negatively charged to the part of the surface of the belt photoconductor 32*a* where the electrostatic latent image is formed so as to form a toner image on the belt photoconductor 32*a*. The transfer unit 36*a* is arranged opposite to the belt photoconductor 32*a* in non-contact therewith and transfers a toner image formed on the belt photoconductor 32*a* by electrostatic attraction onto the form S that is conveyed between the belt photoconductor 32*a* and the transfer unit 36*a*. After the transfer of the toner image is completed, the remaining charge on the surface thereof is removed by a static eliminator (not illustrated). The cleaner 37*a* then collects residual toner remaining on the belt photoconductor 32*a* that has not been transferred onto the form S.

Similarly, the second side printing section 4 includes printing units 40*a*, 40*b*, 40*c*, and 40*d* that are vertically arranged sequentially from below. The constitution of the printing units 40*a*, 40*b*, 40*c*, and 40*d* is the same as that of the printing unit 30*a* mentioned above, so that a detailed explanation thereof will be omitted. Further, the second side printing section 4 additionally includes form conveying rollers 9 and 10, a wrapping roller 11, and a plurality of cleaners 21 installed on the rollers 9, 10, and 11.

The fixing section 5 includes a form conveying roller 12, a cleaner 21, and a fixing unit 13. The fixing unit 13 heats and fixes an unfixed toner image that has been formed on the form S.

In such a constitution, the form S sent from the paper feed unit 2 to the first side printing section 3 is conveyed in the first side printing section 3 vertically upward from below, and a toner image is sequentially formed on the first side of the form by the printing units 30*a*, 30*b*, 30*c*, and 30*d*; and then, the conveying direction is changed by the form conveying roller 7, and the form is sent to the second side printing section 4. In the second side printing section 4, the form S is conveyed vertically upward from below via the form conveying roller 9, and a toner image is sequentially formed on the second side of the form by the printing units 40*a*, 40*b*, 40*c*, and 40*d*; and then, the form is sent to the fixing section 5 via the form conveying roller 10. In the fixing section 5, the form is conveyed vertically downward from above via the form conveying roller 12; and, in the fixing unit 13, the unfixed toner image is heated and fixed onto the form S. Thereafter, the form S is discharged to the outside.

Here, when the form S passes the form conveying roller 9 and the wrapping roller 11, the toner image formed on the first side of the form S is not fixed to the form S. Therefore, when the form S passes the form conveying roller 9 and the wrapping roller 11, the toner on the form S may be re-transferred onto the rollers 9 and 11. Therefore, in this embodiment, any toner that has been re-transferred onto the rollers 9 and 11 is collected using the cleaners 21 and 22. Similarly, on the second side of the form S passing the form conveying rollers 10 and 12, an unfixed toner image is formed, so that toner may be re-transferred also onto the form conveying rollers 10 and 12. Thus, in this embodiment, any toner that has been re-transferred onto the form conveying rollers 10 and 12 is cleaned using the cleaners 21 and 22.

Here, to increase the transfer width and realize a high image quality, the form S is wrapped on the belt photoconductors 32*a* to 32*d* and 42*a* to 42*d* with a fixed wrapping width of W. The wrapping width W is 10 mm. To find an optimal value of the wrapping width of the belt photoconductors 32*a* to 32*d* and 42*a* to 42*d* and the form S, the wrapping width W is changed by changing the wrapping angle, and the results of evaluation of the print quality for each wrapping width W are shown in Table 1. In the present embodiment, the wrapping width is set at 10 mm. However, as shown in Table 1, when the wrapping width W is set within the range from 5 to 25 mm, no uneven print concentration and image rubbing occur, and the print quality is satisfactory. Uneven print concentration is generated by a non-uniform transfer efficiency. However, it is caused by uneven adhesion between the form S and the belt photoconductors 32*a* to 32*d* and 42*a* to 42*d* and uneven resistance of the form S. When the wrapping width W is increased, the adhesion between the form S and the belt photoconductors 32*a* to 32*d* and 42*a* to 42*d* is improved, and the transfer time is prolonged, so that the transfer efficiency becomes uniform and uneven print concentration is eliminated. Further, image rubbing is generated when a toner image, at the time of transfer, is dragged due to a speed difference between the form S and the belt photoconductors 32*a* to 32*d* and 42*a* to 42*d*. The form speed may not conform to the specified speed due to an error in the outer diameter of the conveying roller which conveys the form S, due to rotation variations, and due to a thickness difference of the form. Similarly, the speed of each of the belt photoconductors 32*a* to 32*d* and 42*a* to 42*d* may not conform to the specified speed due to an error in the outer diameter of the conveying roller, rotation variations, and due to a thickness error of the belt photoconductors 32*a* to 32*d* and 42*a* to 42*d*, whereby a speed difference is generated between the form S and the belt photoconductors 32*a* to 32*d* and 42*a* to 42*d*. Generally, a speed difference of 0.5 to 5% of the specified speed is generated.

TABLE 1

Relationship between wrapping width and print quality

| Wrapping width W | Uneven print concentration | Image rubbing |
|---|---|---|
| 1 mm | Much | None |
| 3 mm | Little | None |
| 5 mm | None | None |
| 10 mm | None | None |
| 15 mm | None | None |
| 20 mm | None | None |
| 25 mm | None | None |
| 30 mm | None | Little |
| 35 mm | None | Little |

Assuming that the rubbing amount from start of wrapping to the end of wrapping between the form S and the belt photoconductors 32*a* to 32*d* and 42*a* to 42*d* is K (mm), the wrapping time is T (s), the specified speed is V (mm/s), the speed difference is ΔV (mm/s), and the wrapping width is W (mm), the following Formula 1 is determined:

$$T=W/V$$

$$K=\Delta V\times T=\Delta V\times W/V \qquad \text{Formula 1}$$

This formula is satisfied when no electrostatic attraction and frictional force exist between the form S and the belt photoconductors 32*a* to 32*d* and 42*a* to 42*d*. However, in actual practice, electrostatic attraction and frictional force are applied, so that the rubbing amount K cannot be calculated accurately from this formula, though a qualitative understanding can be obtained from this formula. The formula shows that, as the wrapping width W is increased, the rubbing amount K is increased. Therefore, it can be understood that the wrapping width has an optimal range. As a means for wrapping the form S around the belt photoconductors 32*a* to 32*d* and 42*a* to 42*d*, in this embodiment, the form conveying rollers 6, 7, 9, and 10 and the wrapping rollers 8 and 11 are used. An example relating to the first side printing section 3 will be explained.

Figure 2:
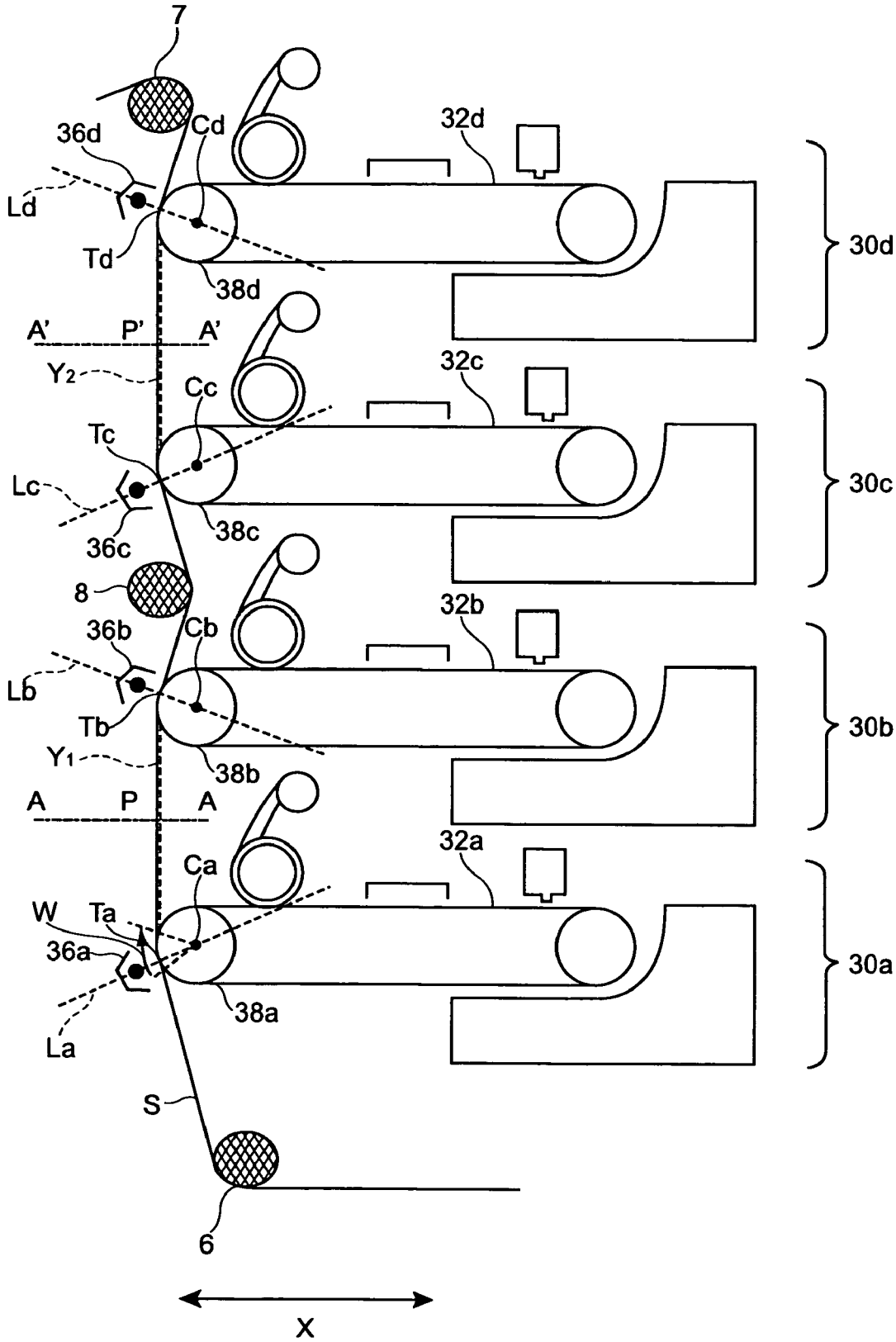
FIG. 2 is an enlarged side view of a section of the printer forming the embodiment of the present invention.
Figure 3:
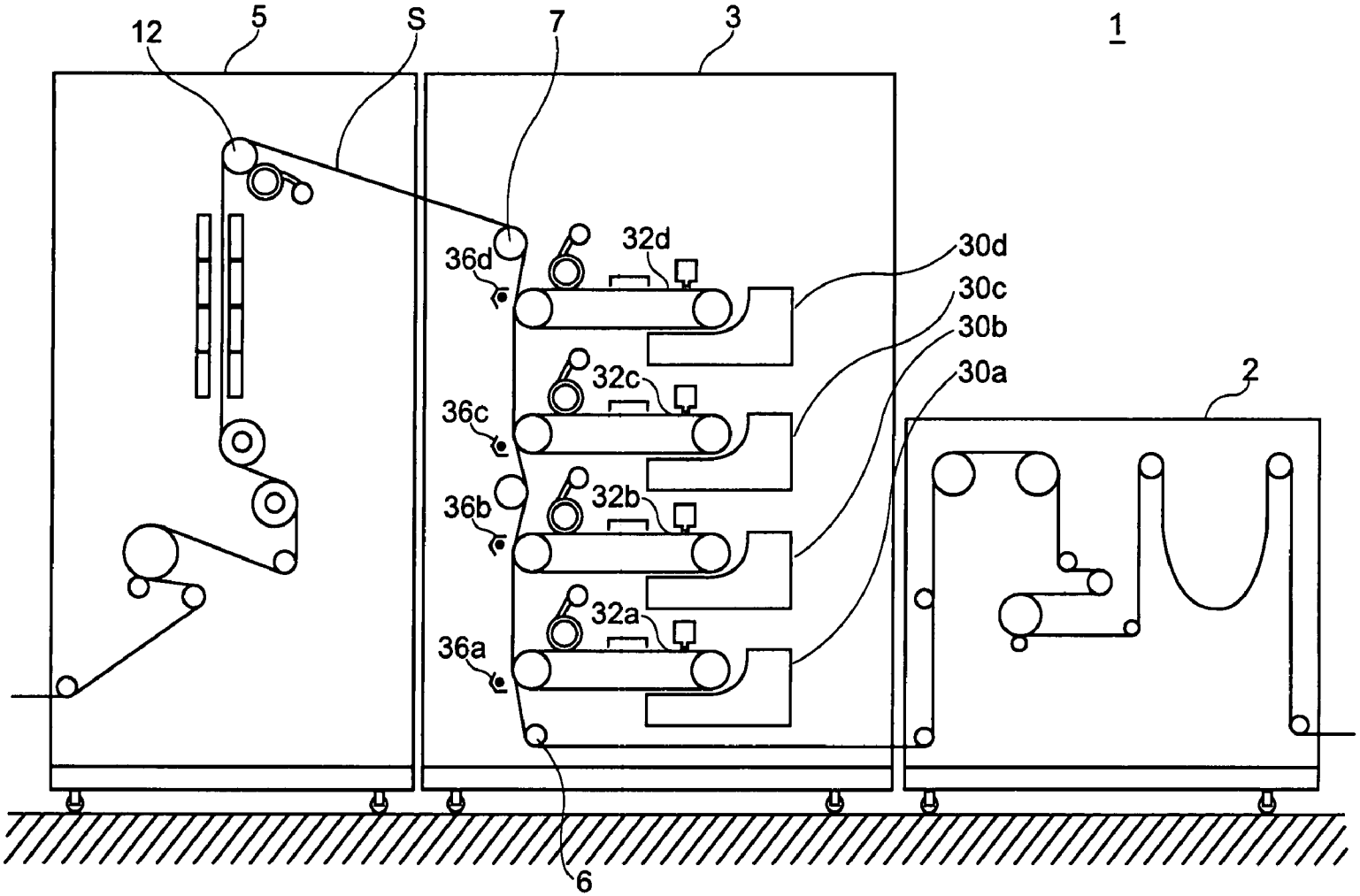
FIG. 3 is a diagram showing the state of the printer at a time in which the second side printing section is removed to form a one-side printer.
Figure 8:
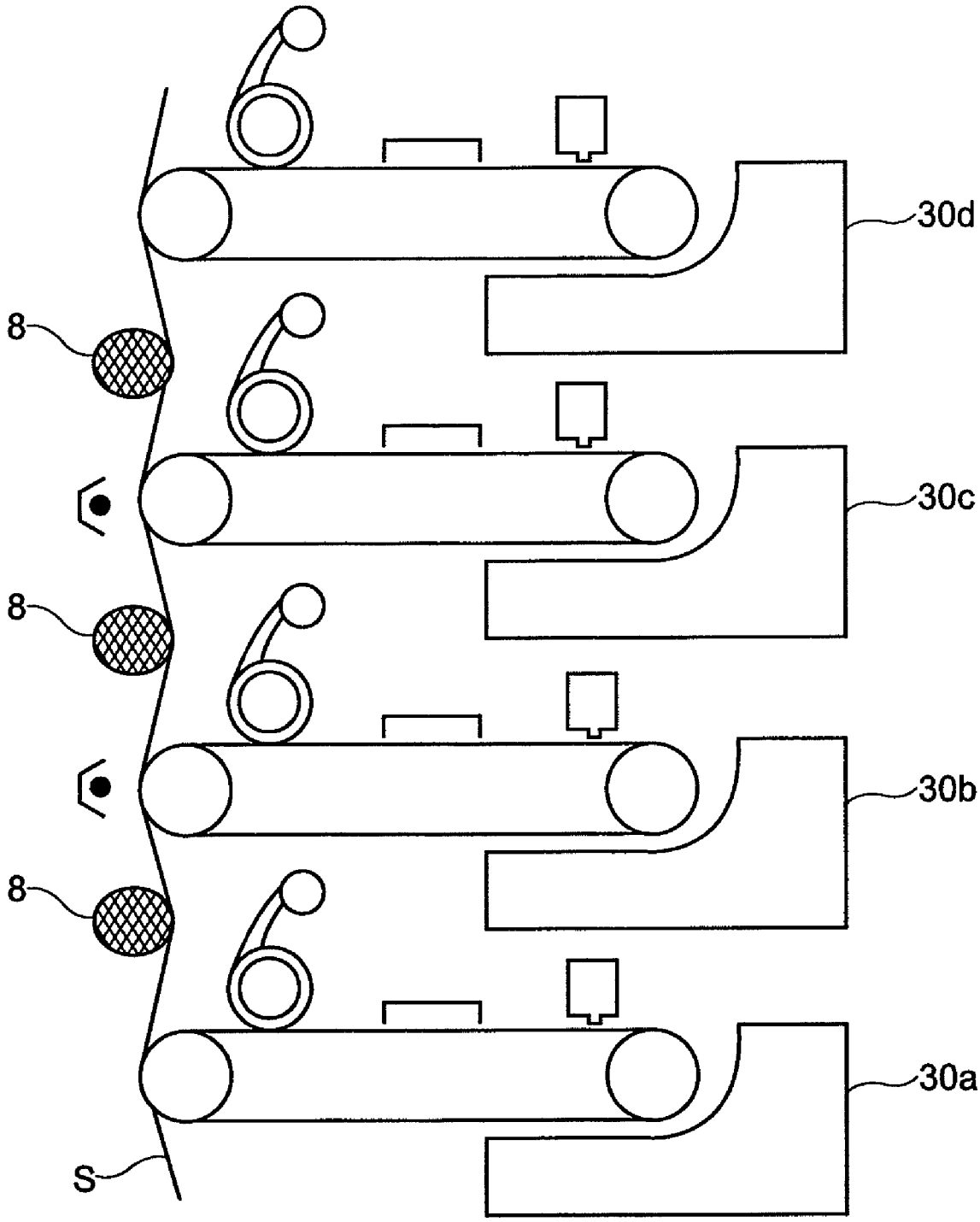
FIG. 8 (Prior Art)
FIG. 8 is a diagram showing a section of a conventional printer configuration.

As shown in FIG. 2, in this embodiment, wrapping the form S around the belt photoconductors 32*a* to 32*d*, which is necessary to realize a high image quality, is carried out only by use of three rollers, including one wrapping roller 8 and two form conveying rollers 6 and 7. Here, for comparison, the constitution in which the form S is wrapped around the belt photoconductors 32*a* to 32*d* by applying conventional techniques is shown in FIG. 8. In the example shown in FIG. 8, a wrapping roller 8 is installed not only between the printing units 30*b* and 30*c*, but also between the printing units 30*a* and 30*b* and between the printing units 30*c* and 30*d*. On the other hand, in this embodiment, as shown in FIG. 2, between the printing units 30*a* and 30*b* and between the printing units 30*c* and 30*d*, no wrapping roller 8 is installed. As mentioned above, according to this embodiment, compared with the arrangement in FIG. 8, by use of very few wrapping rollers 8, the wrapping width W of the form S around the belt photoconductors 32*a* to 32*d* can be reserved.

Next, the arrangement of the form conveying rollers 6 and 7, the wrapping roller 8, and the transfer sections 36*a* to 36*d*, for enabling the constitution shown in FIG. 2, will be explained. In FIG. 2, the straight line connecting transfer points Ta and Tb of the printing units 30*a* and 30*b* is designated Y1, and the direction perpendicular to the straight line Y1 is assumed to be X.

Further, the line which passes through the intermediate point between the transfer points Ta and Tb and is parallel with the direction X is assumed to be a central line A-A. And, the form conveying roller 6, the wrapping roller 8 and the transfer units 36*a* and 36*b* are arranged so that a line La connecting the center Ca of the roller 38*a* and the transfer point Ta and a line Lb connecting the center Cb of the roller 38*b* and the transfer point Tb are inclined to the central line A-A and are almost symmetric to the central line A-A. By use of such a constitution, even though a wrapping roller is not arranged between the two neighboring printing units 30*a* and 30*b*, the form S can be wrapped around the belt photoconductors 32*a* to 32*d* within the range of the wrapping width W from 5 to 25 mm, as shown in Table 1.

Similarly, in the relation between the printing units 30*c* and 30*d*, the straight line connecting transfer points Tc and Td of the printing units 30*c* and 30*d* is designated as Y2, and the direction perpendicular to the straight line Y2 is assumed to be X. Again, the form conveying roller 7, the wrapping roller 8, and the transfer units 36*c* and 36*d* are arranged so that a line Lc connecting the center Cc of the roller 38*c* and the transfer point Tc and a line Ld connecting the center Cd of the roller 38*d* and the transfer point Td are inclined to a central line A'-A' which passes the intermediate point P' between the transfer points Tc and Td and is parallel with the direction X and are almost symmetric to the central line A'-A'. By use of such a constitution, even though a wrapping roller is not arranged between the two neighboring printing units 30*c* and 30*d*, the form S can be wrapped around the belt photoconductors 32*a* to 32*d* within the range of the wrapping width W from 5 to 25 mm, as shown in Table 1.

As mentioned above, according to this embodiment, the number of wrapping rollers can be reduced, so that variations in the form speed due to an eccentricity of the wrapping rollers can be reduced, and image deterioration can be minimized, and a high image quality of first side printing can be realized. Further, the same may be said with the second side printing section 4, so that a detailed explanation thereof will be omitted. However, to the first side printing section 3, the number of wrapping rollers is reduced, and image deterioration due to an eccentricity of the wrapping rollers is minimized, and a high image quality of second side printing is realized.

Furthermore, in the second side printing section, in correspondence to the reduction in the number of wrapping rollers, the number of cleaners relating to it can be reduced. Further, the printing units 30*a* to 30*d* and 40*a* to 40*d* have the same constitution, so that a cost reduction due to sharing of parts can be realized. Further, the printing units 40*a* to 40*d* may have a mirror constitution instead of the same constitution as that of the printing units 30*a* to 30*d*.

Here, as mentioned above, the first side printing section 3, the second side printing section 4, and the fixing section 5 are arranged in separate frames 31, 41, and 51, and the frames 31, 41, and 51 are removably joined to each other, so that when printing is to be carried out only on the first side of the form S, the second side printing section 4 can be removed, and the first side printing section 3 and the fixing section 5 joined to each other. Thus, thus a one-side printer, as shown in FIG. 3, can be formed, and one-side printing can be executed without operating the second side printing section 4. By use of such a constitution, several problems can be prevented. For example, when executing one-side printing using a double-side printer, due to the contact wear between the photoconductor of the second side printing section and the form, the life span of parts is shortened and the cost of expendables is increased and the first side of the form is wrapped around an unnecessary form conveying roller and is conveyed, resulting in image deterioration, which can be prevented with the present invention. Further, when both sides of the form S must be printed again, as shown in FIG. 1, the second side printing section 4 is joined between the first side printing section 3 and the fixing section 5, thereby a double-side printer may be re-formed.

In this embodiment, the form conveying direction of the first side printing section 3 and the form conveying direction of the second side printing section 4 are the same (vertically upward from below), so that the form conveying path from the second side printing section 4 to the fixing section 5, when the printer 1 is formed as a double-side printer, and the form conveying path from the first side printing section 3 to the fixing section 5, when the printer 1 is formed as a one-side printer, can be almost the same. Thus, the change from a one-side printer to a double-side printer and from a double-side printer to a one-side printer can be executed easily.

Further, according to this embodiment, belt conductors are adopted, so that the height of the whole printer 1 is reduced, and the four printing units necessary for color printing are vertically lined up in a limited space, whereby multi-color printing can be executed.

Figure 4:
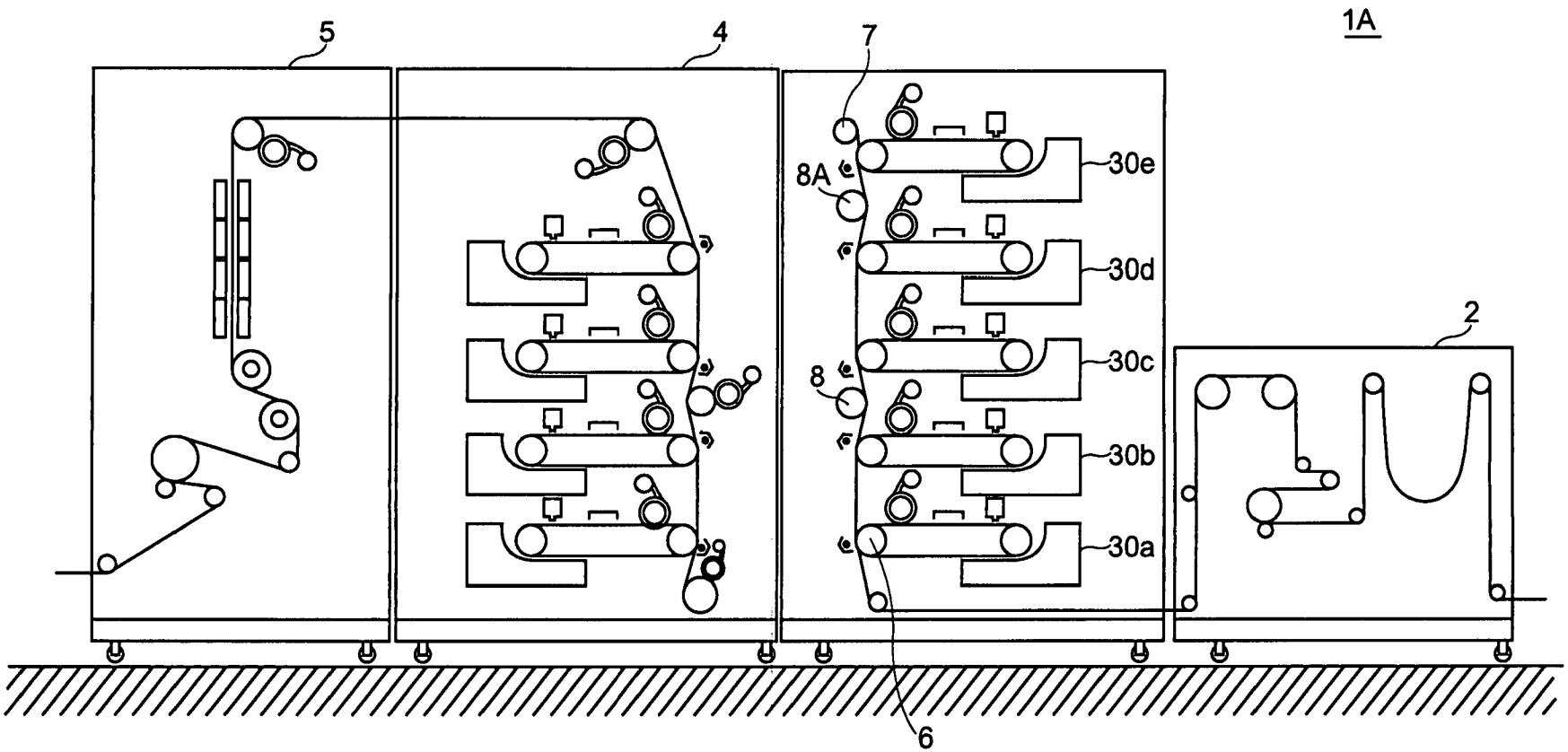
FIG. 4 is a diagram showing a modification of the printer of representing an embodiment of the present invention.
Figure 5:
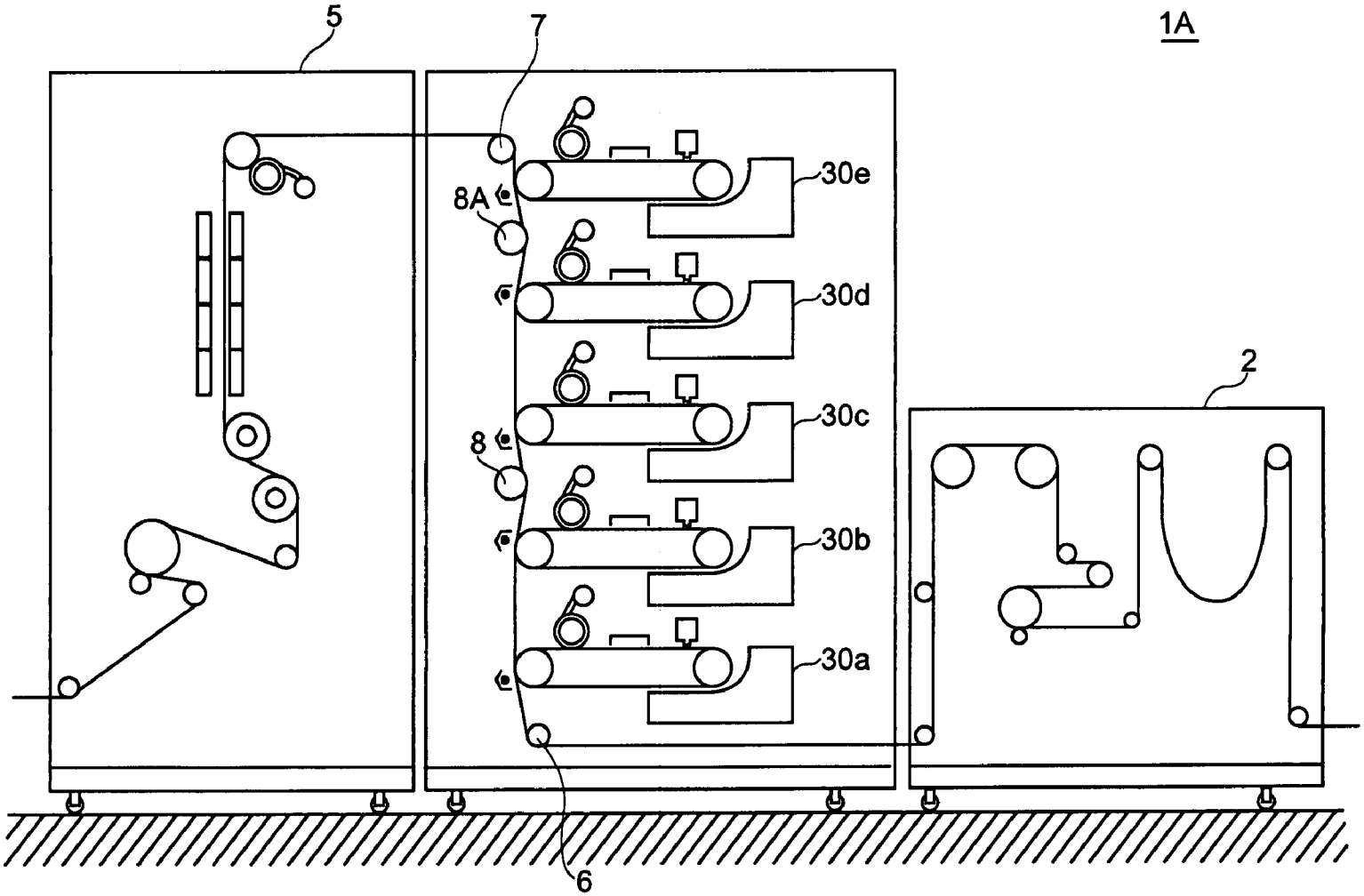
FIG. 5 is a diagram showing a modification of the printer of representing an embodiment of the present invention.

In FIGS. 4 and 5, a modification of this embodiment is shown. In this modification, in addition to the printing units 30*a* to 30*d*, has a printing unit 30*e* for a custom color. Further, in addition to the wrapping roller 8 between the printing units 30*a* and 30*b*, a wrapping roller 8A is arranged between the printing units 30*d* and 30*e*.

Also, in this modified constitution, the number of necessary wrapping rollers can be reduced, and image deterioration due to an eccentricity of the wrapping rollers is minimized, and a high image quality of printed images can be realized.

The printer of the present invention is not limited to the aforementioned embodiment and can be variously modified and improved within the scope embodiment in the appended claims. For example, when the first side printing section and second side printing section are installed in the same frame, thereby forming a single unit, a further cost reduction can be realized.

Figure 6:
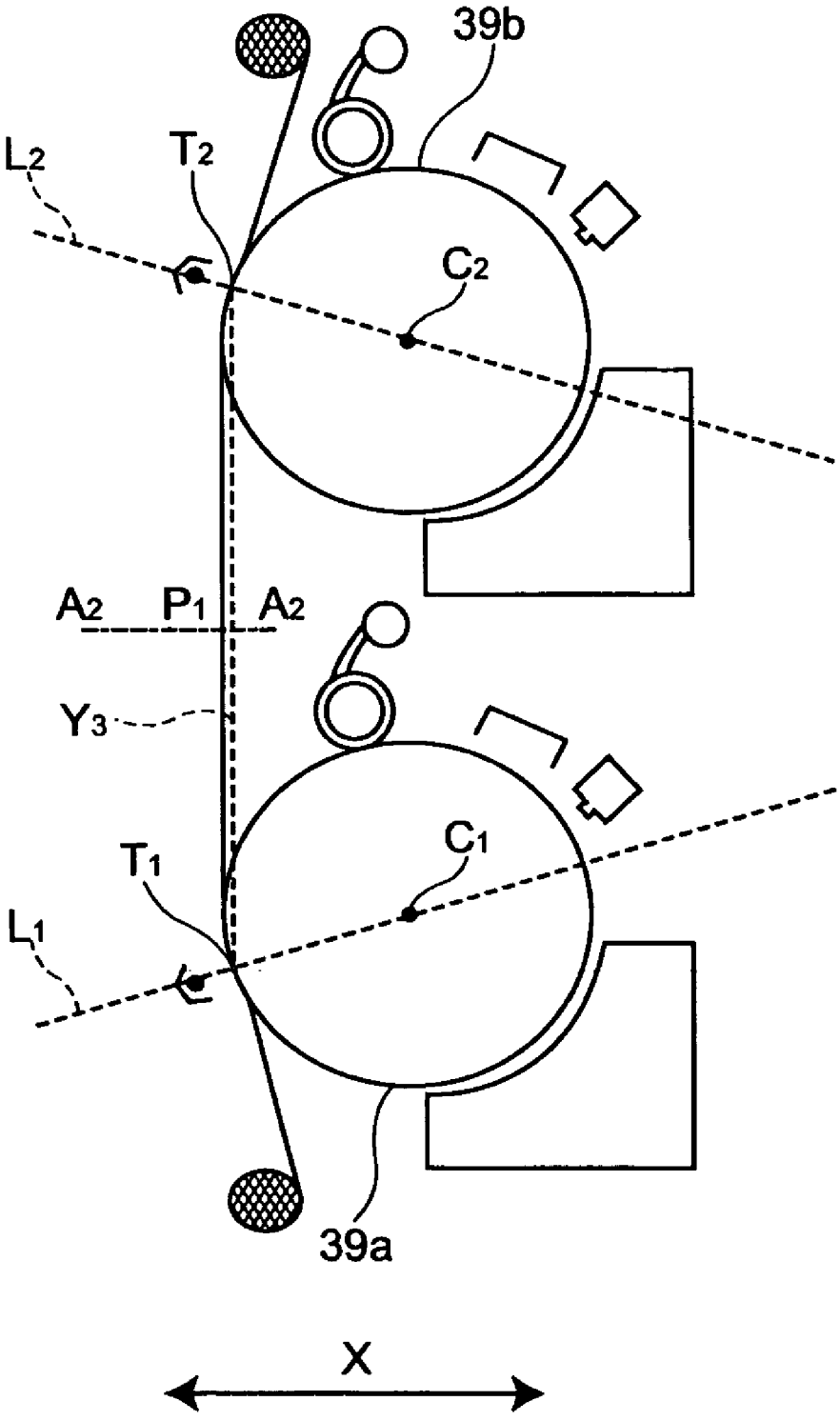
FIG. 6 is a diagram showing a state of the printer shown in FIG. 5, from which the second side printing section is removed.
Figure 7:
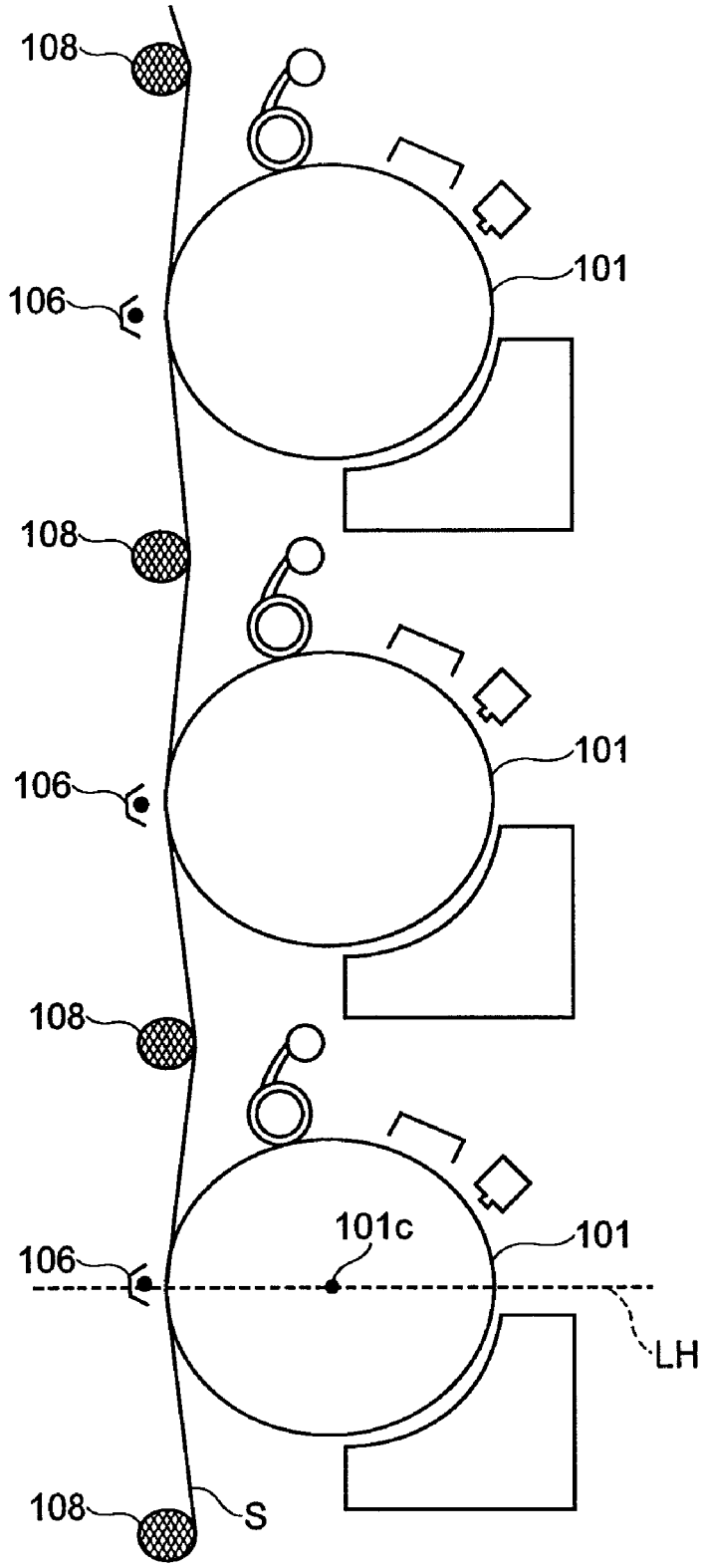
FIG. 7 (Prior Art)
FIG. 7 is an enlarged side view of a section of a conventional printer.

Further, in place of the belt photoconductors, drum photoconductors may be used. In this case, as shown in FIG. 6, the direction perpendicular to a straight line Y3 connecting transfer points T1 and T2 is assumed to be X and a line L1 connecting the center C1 of a drum photoconductor 39*a* and a transfer point T1 and a line L2 connecting the center C2 of a drum photoconductor 39*b* and a transfer point T2 may be formed so as to be inclined to a central line A2-A2 which passes the intermediate point P1 between the transfer points T1 and T2 and is parallel with the direction X and to be almost symmetric to the central line A2-A2. However, as shown in FIGS. 2 and 6, even if the photoconductors have the same circumferential length, adoption of the belt photoconductors can greatly reduce the height of the printing units as compared adoption of the drum photoconductors. Further, the present invention can be applied not only to color printers, but also to monochromatic printers and spot color printers.

Further, in the above-described embodiment of the present invention, a printer using paper as the recording medium was explained. However, in accordance with the present invention, an interspaced transfer unit supported to be endlessly movable may be used instead of paper.

Figure 9:
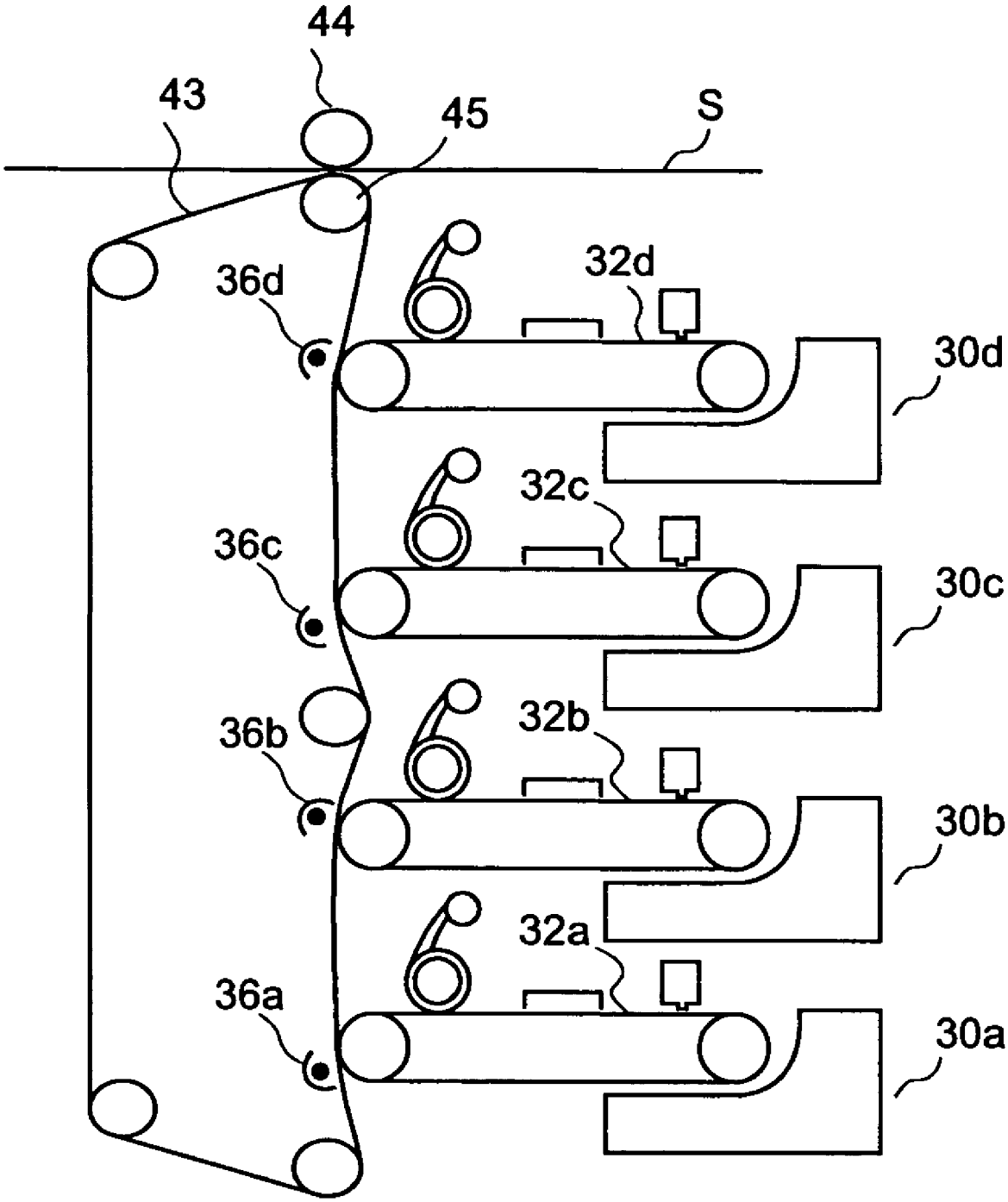
FIG. 9 is a diagram of a printer representing another embodiment of the present invention, using an interspaced transfer unit supported so as to be endlessly movable.

In FIG. 9, an interspaced transfer unit 43 is supported so as to be endlessly movable by plural supporting rollers 45. A toner image formed on the round belt photoconductors 32*a* to 32*d* is transferred to the interspaced transfer unit 43 at transfer units 36*a* to 36*d*, and the image is again transferred to the paper S at a second transfer unit 44.

Therefore, when using an interspaced transfer unit supported so as to be endlessly movable on the printer, as shown in FIG. 9, a constant wrapping width relative to the round belt photoconductors 32*a* to 32*d* of the interspaced transfer unit 43 can be obtained without arranging plural supporting rollers 45 between the printing units 30*a* and 30*b*, and the printing units 30*c* and 30*d*.

What is claimed is:

1. A printer for forming a toner image on a recording medium, comprising:

a first printing unit for forming a toner image on a first side of said recording medium and second, third, and fourth printing units, respective ones of said second, third and fourth printing units forming a toner image on said first side of said recording medium;

wherein said first printing unit has a first rotation member arranged on said first side of said recording medium and a first transfer unit arranged opposite to said first rotation member for transferring a toner mage onto said first side of said recording medium at a first transfer position;

respective ones of said second, third, and fourth printing units having respective ones of second, third, and fourth rotation members arranged on said first side of said recording medium and respective second, third and fourth transfer units arranged opposite to respective ones of said second rotation member for transferring a toner image onto said first side of said recording medium at respective ones of second, third, and fourth transfer position;

wherein a first straight line connecting a central point of said first rotation member and said first transfer position is inclined to a perpendicular direction in relation to a second straight line connecting said first transfer position and said second transfer position, and when said recording medium is conveyed between said first transfer position and said second transfer position along said second straight line, said recording medium is conveyed in a wrapping width of W with each rotation member, and said wrapping width W is 5 mm≦W≦25 mm, said wrapping width W being obtained by selecting positions of two conveying rollers for conveying the recording medium respectively installed above and below the first, second, third and fourth printing units and a position of one single wrapping roller for wrapping the recording medium installed between second and third printing units, wherein wrapping the recording medium around the first, second, third, and fourth rotation member is obtained by the one single wrapping roller and the two conveying rollers without requiring any other roller for said wrapping.

2. A printer according to claim 1, further comprising:

a first side printing section having said first, second, third, and fourth printing units, a second side printing section for forming a toner image on second side opposite to said first side of said recording medium, and a fixing section for fixing a toner image transferred to said recording medium on said recording medium, wherein said first side printing section, said second side printing section, and said fixing section are formed respectively in different frames. and said frames are removably fixed to each other.

3. A printer according to claim 2, wherein said recording medium, in said first printing section and said second printing section, is conveyed vertically upward from below.

4. A printer according to claim 2 or 3, wherein said second side printing section has at least one printing unit for forming a toner image on said second side of said recording medium conveyed and said at least one printing unit has the same constitution as that of said first printing unit of said first printing section or a mirror constitution.

5. A printer according to any one of claims 1, 2 and 3, wherein said first rotation member and said second rotation member are drum photoconductors.

6. A printer according to any one of claims 1, 2 and 3, wherein said first respective first, second, third, and fourth printing unit further have an endless belt photoconductor wrapped around said respective first, second, third, and fourth rotation members.

7. A printer according to any of claims 1, 2 and 3, wherein said recording medium is an interspaced transfer unit supported to be endlessly movable.

8. A printer according to claim 4, wherein said first rotation member and said second rotation member are drum photoconductors.

9. A printer according to claim 7, wherein said recording member is an interspaced transfer unit supported to be endlessly movable.

10. A printer for forming a tone image on a recording medium comprising:

a firsr printing unit for forming a toner image to be conveyed on a first side of said recording medium and second, third, and fourth printing units, respective ones of said recording medium;

wherein said first printing unit has a first rotation member arranged on said first side of said recording medium and a first transfer unit arranged opposite to said first rotation member for transferring a toner image onto said first side of said recording medium at a first transfer position;

respective ones of said second, third, and fourth printing units having respective ones of second, third and fourth rotation members arranged on said first side of said recording medium and respective second, third, and fourth transfer units arranged opposite to respective ones of said second, third, and fourth rotation members for transferring a toner image onto said first side of said recording medium at respective ones of second, third, and fourth transfer positions;

wherein a first straight line connecting a cnetral point of said first rotation member and said first transfer position is inclined to a perpendicular direction in relation to a second straight line connecting to said first transfer position and said second transfer position, and means for improving the adhesion and prolonging the transfer time of the recording medium, said means comprising setting the wrapping width W with each rotation member such that 5 mm≦W≧25 mm, when said recording medium is conveyed between said first transfer position and said second transfer positon along said second straight line, said wrapping width W being obtained by selecting positions of two conveying rollers for conveying the recording medium respectively installed above and below the first, second, third, and fourth printing units and a position of one single wrapping roller for wrapping the recording medium installed between said second and third printing units, and wherein wrapping the recording medium around the first, second, third, and fourth rotation members is obtained by the one single wrapping roller and the two conveying rollers without requiring any other rollers for said wrapping.

11. A printer for forming a toner image on a recording medium as defined in any one claim 1 and 10, wherein said wrapping roller is installed between said second and third printing units.

* * * * *